US006792402B1

(12) United States Patent
Chen

(10) Patent No.: US 6,792,402 B1
(45) **Date of Patent: *Sep. 14, 2004**

(54) METHOD AND DEVICE FOR DEFINING TABLE OF BIT ALLOCATION IN PROCESSING AUDIO SIGNALS

(75) Inventor: Wen-Yuan Chen, Hsinchu (TW)

(73) Assignee: Winbond Electronics Corp. (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/491,663

(22) Filed: Jan. 27, 2000

(30) Foreign Application Priority Data

Jan. 28, 1999 (TW) ..... 88101334 A

(51) Int. Cl.[7] ..... G10L 11/00
(52) U.S. Cl. ..... 704/200.1; 704/500; 704/502
(58) Field of Search ..... 704/500–504, 704/200.1

(56) References Cited

U.S. PATENT DOCUMENTS 5,357,594 A * 10/1994 Fielder ..... 704/200.1
5,394,473 A * 2/1995 Davidson ..... 704/200.1
5,451,954 A * 9/1995 Davis et al. ..... 341/200
5,479,562 A * 12/1995 Fielder et al. ..... 704/229
5,613,035 A * 3/1997 Kim ..... 704/229
5,632,003 A * 5/1997 Davidson et al. ..... 704/200.1
5,646,961 A * 7/1997 Shoham et al. ..... 375/243
5,721,806 A * 2/1998 Lee ..... 704/222
5,732,391 A * 3/1998 Fiocca ..... 704/201
5,864,802 A * 1/1999 Kim et al. ..... 704/229
5,889,868 A * 3/1999 Moskowitz et al. ..... 382/251
5,956,674 A * 9/1999 Smyth et al. ..... 704/200.1

OTHER PUBLICATIONS

ISO/IEC 11172–3, "Information technology—coding of moving pictures and associated audio for digital storage media at up to about 1.5 Mbit/s", Aug. 1, 1993.*

* cited by examiner

*Primary Examiner*—Doris H. To
*Assistant Examiner*—Michael N. Opsasnick
(74) *Attorney, Agent, or Firm*—Peter F. Corless; Steven M. Jensen; Edwards & Angell, LLP

(57) ABSTRACT

A method and a device for defining bit allocation table in processing audio signals are provided. The provided method and device can save storage bits and provide light quality as well. In the first step, the total number of bits for storing audio signals is determined. Then the psychoacoustic model provides many signal-to-mask ratios according to the audio signals. At last, the quantizer quantizes the signal-to-mask ratios to generate several quantized levels each of which corresponds to a bit allocation value to define the table of bit allocation. Therefore, fewer or no storage bits are provided for unimportant subbands and signal frames, that is, the efficiency and quality of transmission of audio signals can be raised.

11 Claims, 5 Drawing Sheets

METHOD AND DEVICE FOR DEFINING TABLE OF BIT ALLOCATION IN PROCESSING AUDIO SIGNALS

FIELD OF THE INVENTION

The present invention relates to a method and a device for defining the table of bit allocations and more particularly to a method and a device for defining the table of bit allocation in processing audio signals.

BACKGROUND OF THE INVENTION

The recent subband encoders, developed from the human acoustic system, can compress audio signals with great change in frequency. Music is a typical example of audio signals. The compression ratio becomes more and more important recently because the data transmission between computers is very frequent in internet world. The basic principle of subband encoders is to divide the audio spectrum into several subbands. Then, the audio signals in different subbands are encoded respectively.

Filter bank is often used to divide audio signals. The band-pass filters in the filter bank restrict the frequency range of the audio signals in the subbands. It is known that Nyquist ratio is adapted to sample, quantize, encode, multiplex, and transmit the audio signals. These steps are indirectly controlled by a psychoacoustic model. The psychoacoustic model will define a table of bit allocation to determine the number of bits to store the audio signals in respective subbands. Then, the audio signals are converted into digital signals for the purpose of transmission. That is, the table of bit allocation plays an important role in transmitting audio signals. The masking threshold estimation is always used to control the quantizer if possible.

After the digital signals are transmitted, the receiving end must reconstruct them to show the original music. The subband decoder demultiplexes, decodes, up-samples, and mixes these digital signals to restore the audio signals. These steps are also based on the table of bit allocation.

Please refer to FIG. 1 which is a block diagram showing a conventional subband encoder. The audio signals s(n) are inputted into the band-pass filters 11 to become several subband signals $B_1 \ldots B_N$. The symbol n means the nth signal frame at specific moment. The subband signals $B_1 \ldots B_N$represent the amplitude of the audio signals in the respective subbands. Then the subband signals $B_1 \ldots B_N$ are respectively decimated by the decimating units 12, that is, the subband signals $B_1 \ldots B_N$ are sampled. Then the encoders 15 encode the obtained signals. The table of bit allocation 13 provided from the psychoacoustic model 14 teaches the encoders 15 the number of bits for storing the data in different subbands and at different moments. After the encoding step, the multiplexer 16 multiplexes all the encoded signals to generate the distal signals x(n). The digital signals x(n) can be easily transmitted to other operating systems or computers by means of cables or telephone lines. By the way, the digital signals x(n) can be stored easily and conveniently because their size are smaller than the audio signals s(n).

An important key to the system is how to determine the table of bit allocation 13. The psychoacoustic model 14 does it based on the acoustic system of human. Human ears can only accept sound with limit frequency. We can not hear audio signals with too high frequency or too low frequency even their amplitude is great, but we can clearly hear the audio signals with middle frequency even their amplitude is not so great. Hence, more bits should be used to store the audio signals in the middle subbands. On the other hand, fewer bits should be used for the subbands with low weight; even no bits are needed.

The encoders 15 quantize the decimated signals according to the table of bit allocation 13. For example, the table of bit allocation 13 indicates that the signals in subband 1 can use 2 bits, the possible encoded data may be one of 00, 01, 10, and 11 to respectively indicate the unloud, loud, louder and loudest voices.

Please refer to FIG. 2 which is a block diagram showing the conventional subband decoder. The reconstruction process is the reverse of the encoding process. At first, the digital signals x(n) are demutltiplexed by the demultiplexer 21 to take out signals in each subband and at each moment. The decoders 22 decode these signals to generate the decoded signals $b_1 \ldots b_N$ according to the information stored in the table of bit allocation 23. The decoded signals $b_1 \ldots b_N$ are up-sampled by the expanding units 24. After passing the band-pass filters 25, all the signals are mixed by the mixer 26 to be combined into audio signals $\underline{s}(n)$. The obtained signals $\underline{s}(n)$ are similar to the original audio signals s(n).

The quality of audio signals reconstructed by the conventional method is not high enough. The principle of the conventional method is to find the minimum noise-to-mask ratio in respective signal frames (about 10–30 ms). The "adb" bits used for each signal frame are calculated from tie following equation:

$$adb = B \div 1000 \times K$$

wherein B is bit rate (bits/sec) and K is frame interval (s). The same frame interval will be allocated the sane bit size. Usually, many signal frames can not be sensed because of masking effects, Such allocation really wastes the bits for storing the audio signals and quality of the audio signals can no be raised. It also increases the production cost. Hence, it is a good idea by using fewer bits to provide the same audio quality or by using the same bits to provide higher audio quality.

SUMMARY OF THE INVENTION

An objective of the present invention is to disclose a method for defining the table of bit allocation in processing audio signals. This method can allocate bits in effective signal frames and subbands. Such bit allocation can both increases transmission efficiency and reduces production cost.

Another objective of the present invention is to disclose a device for defining the table of bit allocation in processing audio signals. This device can allocate bits in effective signal frames and subbands. Such device can both increases transmission efficiency and reduces production cost.

In accordance with the present invention, the defining method includes the following steps. At first step the total number of bits used for storing the audio signals is determined. In this specification, the words "bit allocation value" indicate the number of bits used for storing the audio signals. Then, the psychoacoustic model finds several signal-to-mask ratios in different subbands and at different moments according to the original audio signals. All the signal-to-mask ratios will be quantized to generate some quantized levels. Each quantized level includes at least one signal-to-mask ratios and corresponds to a bit allocation value and a sampled signal-to-mask ratio. Hence, the table of bit allocation composed of the bit allocation values is defined.

In accordance with another aspect of the present invention, the table of bit allocation includes a time axis and a band axis. Therefore, a given moment and subband corresponds to a bit allocation value. Of course, non-effective subframes and subbands correspond to a bit allocation value of 0. The slim of bit allocation values in one signal fire may be different from that in another signal frame. Therefore, the bit allocation is optimized.

In accordance with another aspect of the present invention the quantizing step is explained briefly as follows. First of all, all the bit allocation values must be initialized; that is, they are assigned a value of 0. Then, the signal-to-mask ratios are classified into several quantized levels so that each quantized level has at least one signal-to-mask ratio. In each quantized level, a signal-to-mask ratio suitable for representing the quantized level will be selected to become the sample signal-to-mask ratio. The middle value is a good choice. Then, the mask-to-noise ratios of quantized levels are calculated according to the sample signal-to-mask ratios. The quantized level corresponding to the minimum mask-to-noise ratio is the quantized level with the greatest weight. Therefore, all the bit allocation values of the specific signal frames and subbands included in this quantized level increase, and the total bit allocation value decreases. These steps are repeated until the total bit allocation value becomes 0. Hence, all the bit allocation values are obtained.

An equation is provided to calculate the mask-to-noise ratios.

$$MNR=BQL\times 6.02-SMR$$

Wherein MNR is mask-to-noise ratio, BQL is bit allocation value, and SMR is sample signal-to-mask ratio.

In accordance with the present invention, by way of making reference to the foregoing paragraphs, the device includes a psychoacoustic model, a digital storage unit, and a quantizer. The psychoacoustic model is used for providing the signal-to-mask ratios according to the audio signals. The digital storage unit electrically connected to the psychoacoustic model is used for storing the signal-to-mask ratios. The quantizer electrically connected to the digital storage unit is used for quantizing the signal-to-mask ratios to generate several quantized levels.

In accordance with present invention, the apparatus adopting the present method and device is also disclosed. The apparatus includes a bit allocation device and an audio processor. The bit allocation device has be described in the foregoing paragraphs. The audio processor, i.e. encoding processor or decoding processor, is used for processing the audio signals according to the present table of bit allocation.

The present invention may best be understood through the following description with reference to the accompanying drawings, in which;

DETAILED DESCRIPTION OF PREFERRED EMBODIMENT

Figure 1:
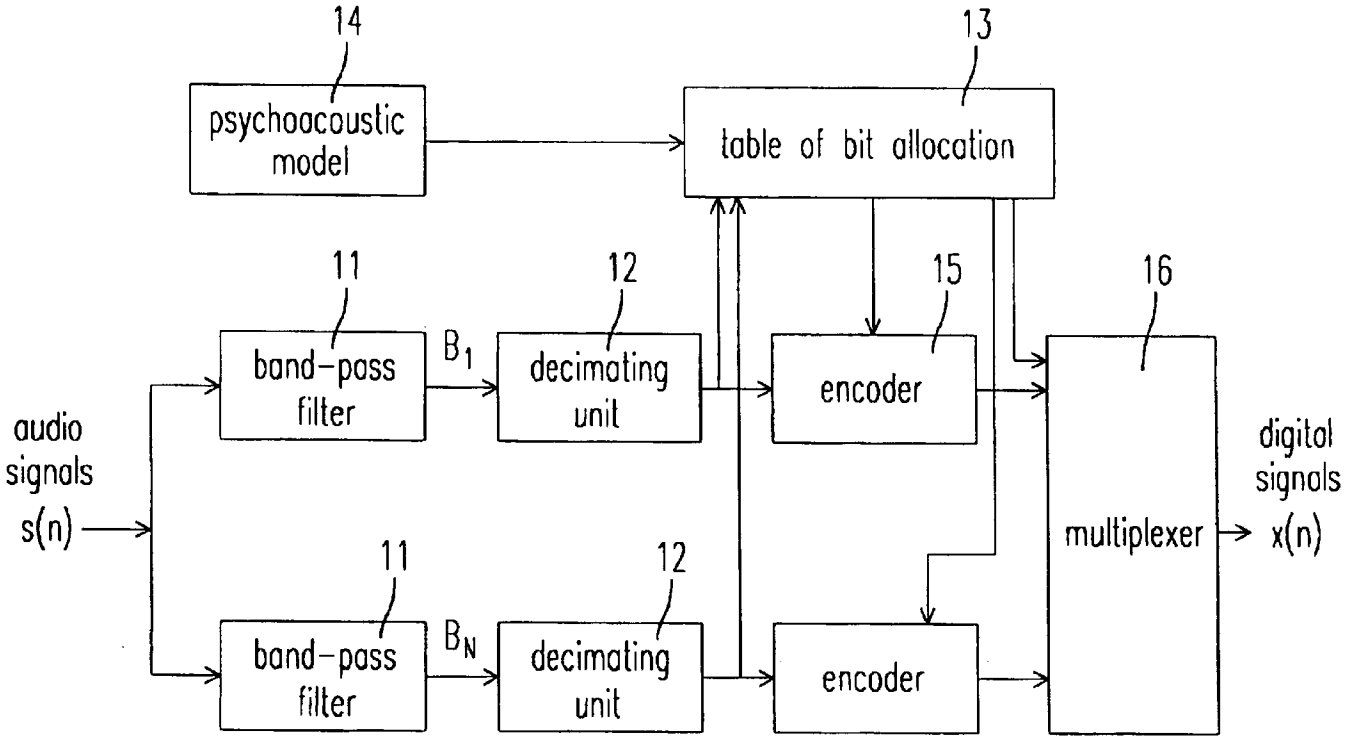
Fig. 1 (PRIOR ART)
FIG. 1 is a block diagram showing the conventional subband encoder.
Figure 2:
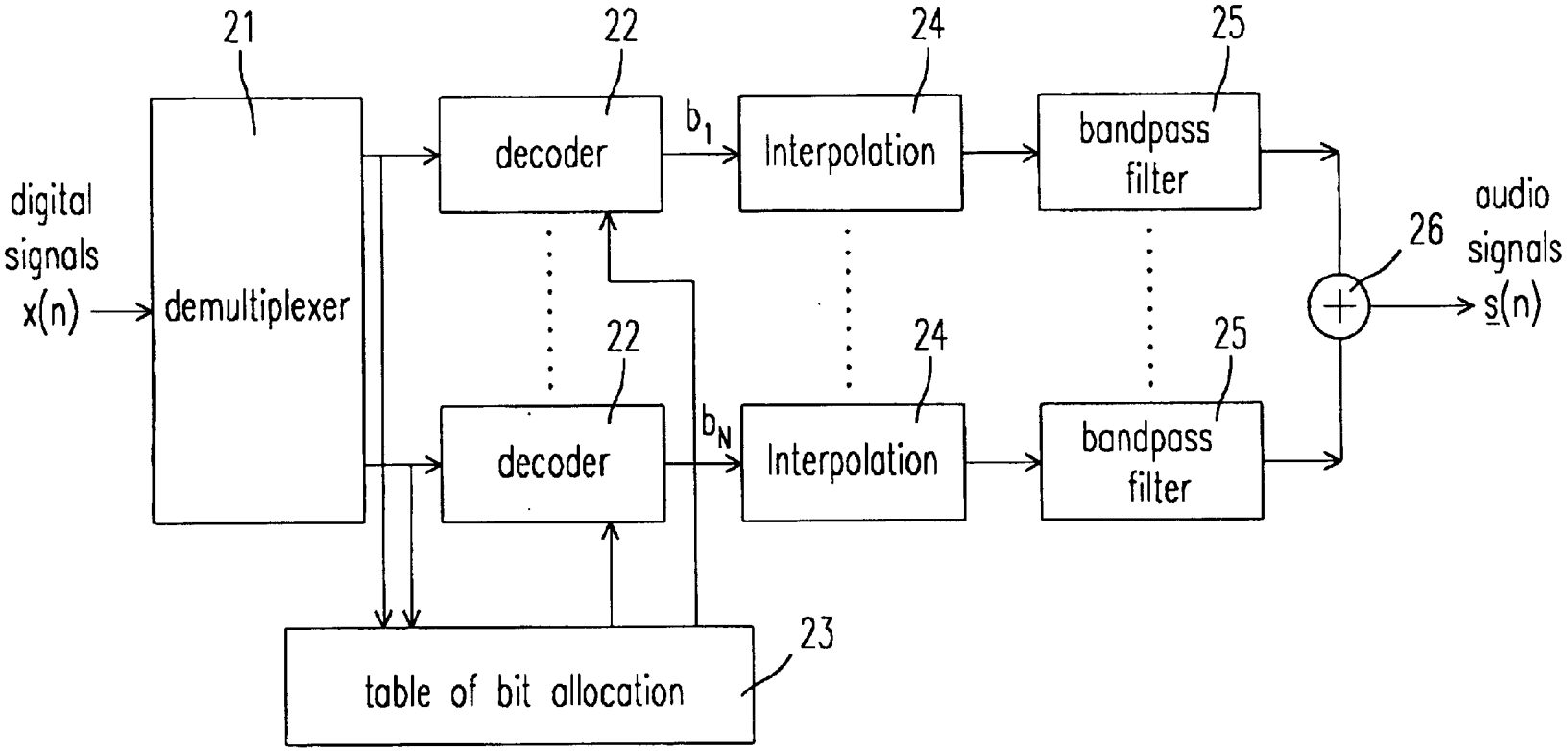
Fig. 2 (PRIOR ART)
FIG. 2 is a block diagram showing the conventional subband decoder.
Figure 3:
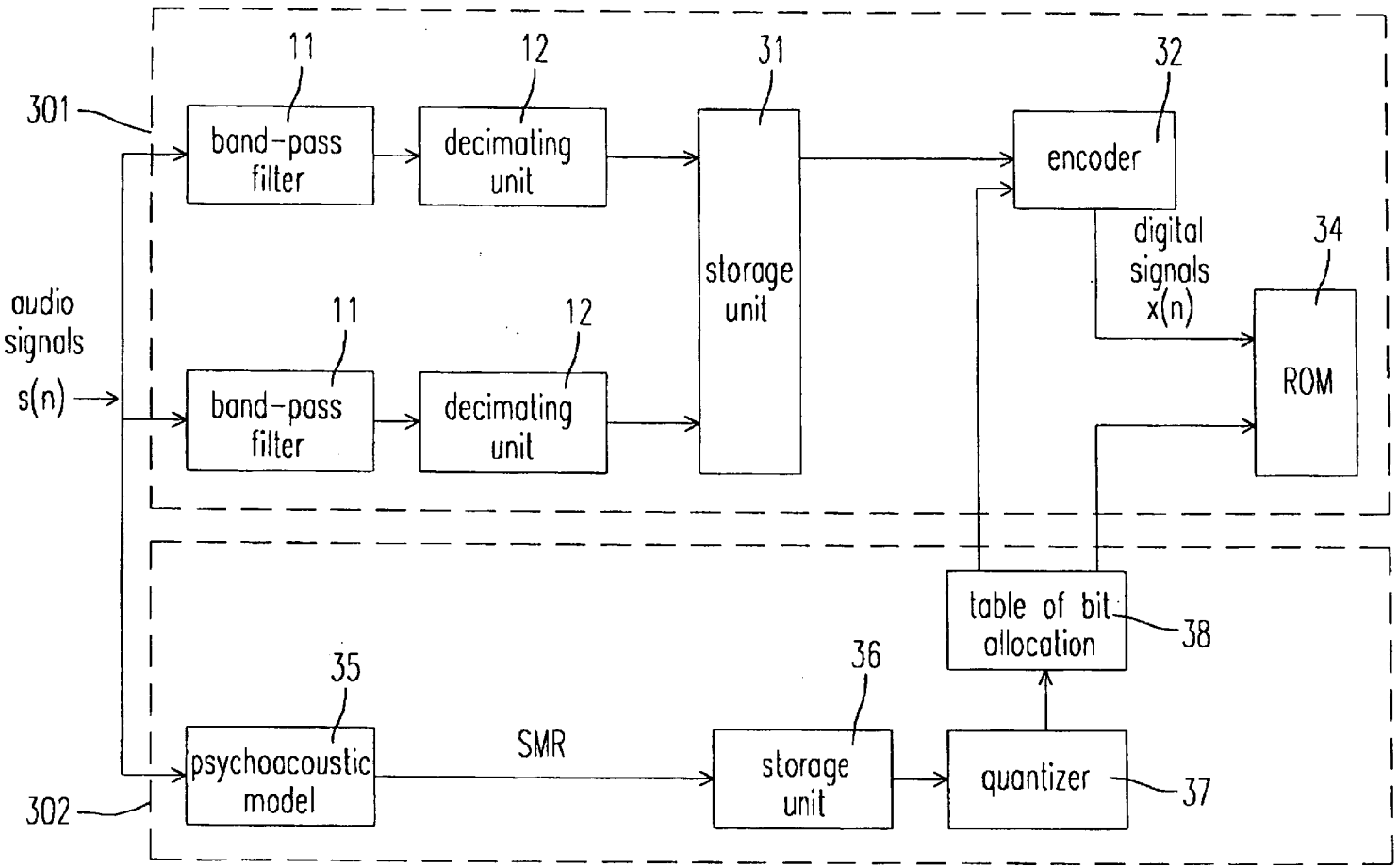
FIG. 3 is a block diagram showing a preferred embodiment of an audio processing apparatus according to the present invention.

Please refer to FIG. 3 which is a block diagram showing a preferred embodiment of an audio processing apparatus according to the present invention. The audio processing apparatus includes two parts, an audio processor 301 and a bit allocation device 302. The bit allocation device 302 includes a psychoacoustic model 35, a storage unit 36, a quantizer 37, and a table of bit allocation 38. It must be emphasized that the audio signals s(n) are inputted to both the audio processor 301 and the bit allocation device 302.

After receiving the audio sits s(n), the psychoacoustic model 35 will provide many signal-to-mask ratios SMR. The storage unit 36 electrically connected to the psychoacoustic mode 35 stores these signal-to-mask ratios SMR. Then the quantizer 37 quantizes these signal-to-mask ratios SMR to generate the bit the bit allocation values. The bit allocation values, sometimes called side information, are stored in the table of bit allocation 38. The table of bit allocation 38 is the basis for processing the audio signals s(n).

The audio processor 301 works as that mentioned in the background of the invention. After receiving the audio signals s(a), the band-pass filters 11 take out the respective signals in different subbands. Then the decimating units 12 sample the subband signals. The obtained signals are stored in the storage unit 31. Then the encoder 32 encodes these signals according to the bit allocation values in the table of bit allocation 38 to get the digital signals x(n). The digital signals x(n) and the side information outputted from the table of bit allocation 38 are stored in the read-only memory (ROM) 34. The data stored in the read-only memory 34 is ready for being transmitted.

In other words, the bit allocation device 302 must receive all the audio signals s(n) before defining the table of bit allocation 38. The weight of both signal frames and subbands will be considered. The table of bit allocation 38 records the bit allocation value in each subband and signal frame. Thus, the encoder 32 can encode these audio signals according to the table of bit allocation 38 with better allocation than the prior arts. The final step is to store the encoded (digital) signals x(n) and the bit allocation values (side information) into the read-only memory 34. These data will be decoded later. The decoding process is similar to the prior arts except the bit allocation values. It is supposed that the disclosed information is enough to construct the audio-decoding apparatus and its structure is not described here.

Figure 4:
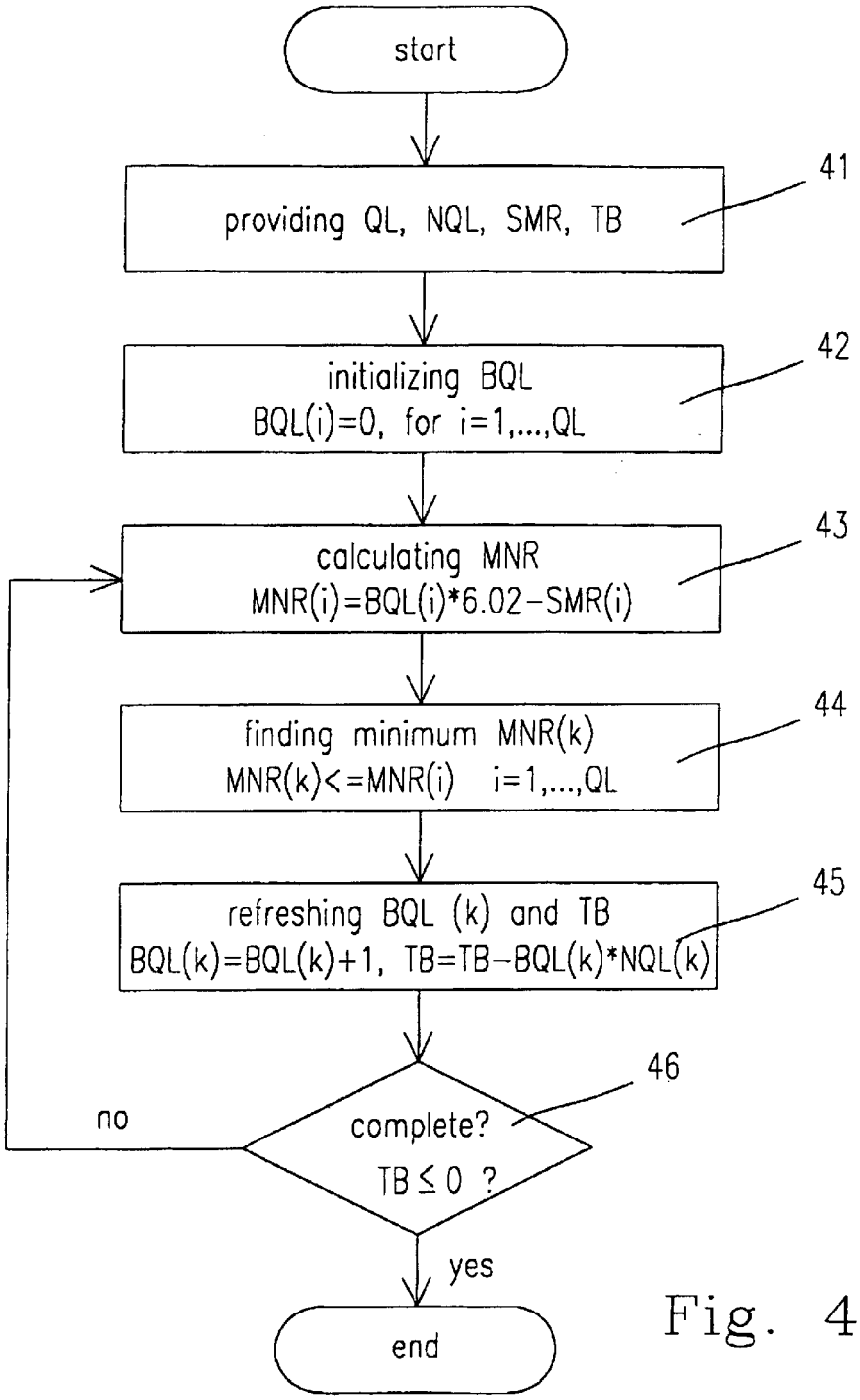
FIG. 4 is a flowchart showing a method for defining the table of bit allocation according to the present invention.

The present invention takes advantage of the optimal bit allocation different from the prior art to achieve the objectives. Please refer to FIG. 4 which is the flowchart showing the method for determining the table of bit allocation according to the present invention. We must define the necessary variables before introducing the steps.

QL: the number of quantized levels, After the psychoacoustic model 35 receives the audio signals s(n), it provides N×T signal-to-mask ratios. N represents the number of subbands in one signal frame, while T represents the number of signal frames. These ratios will be stored in the storage unit 36. Then, the N×T ratios are classified into QL quantized levels. Therefore, it is apparent that N×T>QL.

NQL(i): the number of samples in the ith quantized level, that is, the number of subbands in the ith quantized level. Since, each subband corresponds to one signal-to-mask ratio, the ith quantized level has NQL(i) signal-to-mask ratios. Those values of different quantized levels are not the same.

SMR(i): the sample signal-to-mask ratio which is the representative ratio of the ith quantized level. As mentioned above, the quantized levels have different number of signal-to-mask ratios. A representative value must be selected to represent the characteristic of each quantized level. The representative values are called "sample signal-to-mask ratio" hereinafter in the specification. There are many ways to select the representative values, for example, the middle value is a good choice.

MNR (i): the mask-to-noise ratio of the ith quantized level. These values are derived from the signal-to-mask ratios. The less the value is, the more important the quantized level is.

BQL(i): the number for storing the audio signals in each subband of the ith quantized level. It is called "bit allocation value" hereinafter in the specification. Adding a value to BQL(i) means that the value must be added to all the bit allocation values corresponding to the subbands of the ith quantized level.

TB total number of bits for storing the audio signals. This value is reduced during bit allocation until it becomes 0.

The steps are described in detail in the following paragraphs:

Step 41: providing the variables including QL, NQL, SNR, and TB. TB is determined first. The quantizer 37 provides the other variables.

Step 42: initializing BQL. The value of 0 is assigned to all BQLs, that is, there are no bits for storing the audio signals at the beginning.

Step 43: calculating MNR. The mask-to-noise ratio MNR is calculated from equation: MNR(i)=BQL(i)×6.02−SMR (i). The value 6.02 represents the gain ratio. This is the general rule of analog-to-digital conversion.

Step 44: finding the minimum MNR(k). The minimum MNR(k) means that the weight of the subbands in the kth quantized level is the highest. Hence, each of these subbands must correspond to one more bit now.

Step 45: refreshing BQL(k) and TB. The number of total bits is reduced after some bits are allocated to the kth quantized level.

Step 46: checking if the process is completed. If there are no more bits available, the process is completed, or the quantizer 37 will repeat steps from step 43 to step 46.

Finally all the bit allocation values are obtained. These values accompanying with time intervals and frequency ranges compose the table of bit allocation 38. The encoder 32 can encode the audio signals s(n) according to tile table of bit allocation 38.

Figure 5:
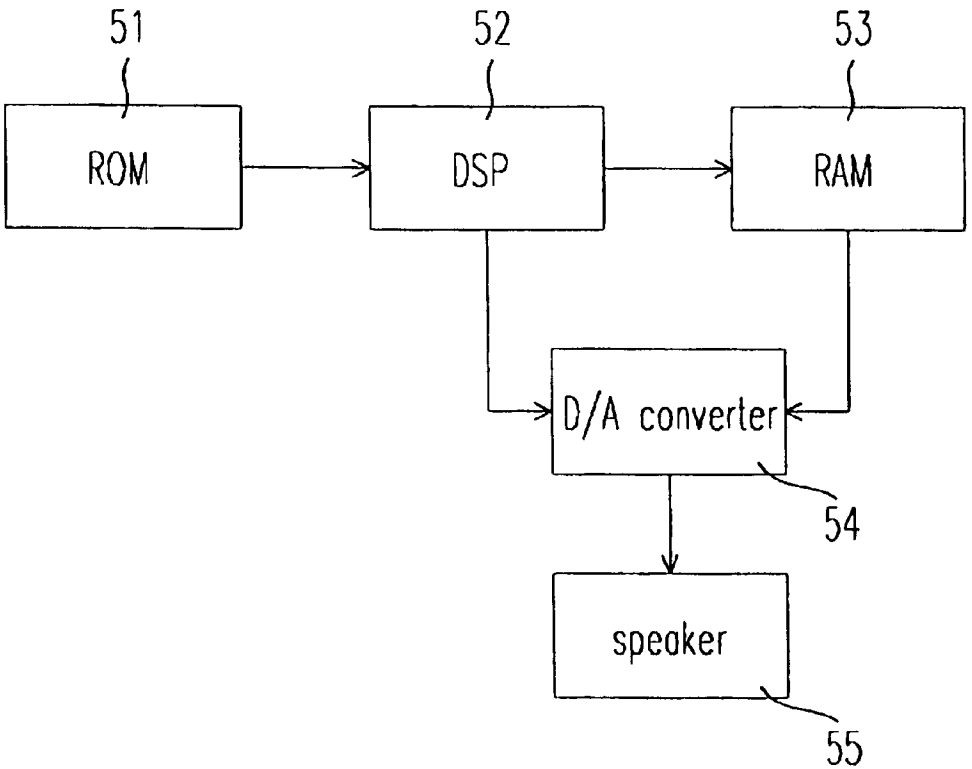
FIG. 5 is a block diagraming showing an application of the present invention.

Please refer to FIG. 5 which is a block diagram showing a general voice synthesis apparatus. This apparatus includes a read-only memory 51, a random-access memory (RAM) 53, a digital signal processor (DSP) 52, a digital-to-analog (D/A) converter 54, a speaker 55, etc. the above-mentioned bit allocation values and encoded signals are stored in the read-only memory 51. The digital signal processor is used for decoding and synthesizing these encoded signals to reconstruct the audio signals. The information of pulse-code modulation is temporally stored in the read-access memory 53. Then the data is converted to analog signals by the digital-to-analog converter 54 before the speaker 55 works. The converting step is controlled by the digital signal processor 52. In other words, the converting step is controlled by the bit allocation values.

It is understood, through the above description with reference to the accompanying drawings, that the characteristic of the present invention is focused on the bit allocation. Fewer or even no bits are provided to store the audio signals in the non-sensible subbands or signal frames. It is apparent that such bit allocation optimizes the signal conversion. It can not only save memory space but also reduce production cost. It is also noted that the quality of the audio signals is not affected.

While the invention has been described in terms of what are presently considered to be the most practical and preferred embodiments, it is to be understood that the invention need not be limited to the disclosed embodiment. On the contrary, it is intended to cover various modifications and similar arrangements included wit the spirit and scope of the appended claims which are to be accorded with the broadest interpretation so as to encompass all such modifications and similar structures.

What is claimed is:

1. A method for defining a table of bit allocation composed of a plurality of bit allocation values in processing entire audio signals over a plurality of bands and times, comprising steps of:

generating a plurality of signal-to-mask ratios according to said entire audio signals after receiving all of said entire audio signals; and quantizing said plurality of signal-to-mask ratios to generate a plurality of quantized levels each of which corresponds to a bit allocation value to define said table of bit allocation over the plurality of bands and times, wherein said table of bit allocation includes a time axis and a band axis so that a specific time coordinate and a specific band coordinate of said table of bit allocation correspond to a specific bit allocation value, and each said quantized level has a different number of said signal-to-mask ratios so that each said bit allocation value is different for each signal frame, thereby allocating a different number of bits in each said signal frame according to a weight of each said signal frame.

2. The method according to claim 1 wherein said plurality of signal-to-mask ratios are determined by a psychoacoustic model after said entire audio signals are inputted to said psychoacoustic model.

3. The method according to claim 1 wherein said quantizing step further comprises steps of:

providing a total bit value;

classifying said plurality of signal-to mask ratios into said plurality of quantized levels so that each of said quantized levels has at least one signal-to-mask ratio;

sampling said at least one signal-to-mask ratio of each quantized level to obtain a plurality of sample signal-to-mask ratios corresponding to said plurality of quantized levels;

calculating a mask-to-noise ratio of each of said plurality of quantized levels;

adding a specific value to one of said bit allocation values of a specific quantized level according to said mask-to-noise ratios, and subtracting another specific value from said total bit value according to said specific value; and repeating said calculating step, said adding step, and said subtracting step until said total bit value reaches 0.

4. The method according to claim 3 wherein before said calculating step, said quantizing step further comprises a step of initializing said plurality of bit allocation values.

5. The method according to claim 4 wherein said bit allocation values are initialized by assigning a value of 0 to each of said plurality of bit allocation values.

6. The method according to claim 3 wherein in said sampling step, said sample signal-to-mask ratio is obtained by selecting the middle value of said some signal-to-mask ratios of said each quantized level.

7. The method according to claim 3 wherein said mask-to-noise ratios are calculated by equation of MNR=BQL× G−SMR in which MNR is said mask-to-noise ratio, BQL is said bit allocation value, G is a gain ratio, and SMR is said sample signal-to-mask ratio.

8. The method according to claim 7 wherein said gain ratio is 6.02.

9. The method according to claim 3 wherein said one bit allocation value corresponds to the minimum mask-to-noise ratio.

10. The method according to claim 3 wherein said specific value is 1 and said another specific value is equal to the number of said some signal-to-mask ratios of said specific quantized level.

11. The method according to claim 1 wherein at least one of said plurality of bit allocation values is 0.

* * * * *